United States Patent [19]

Harris

[11] Patent Number: 4,556,027

[45] Date of Patent: Dec. 3, 1985

[54] EXHAUST BRAKING SYSTEM FOR AN INTERNAL COMBUSTION ENGINE

[75] Inventor: Victor A. Harris, London, England

[73] Assignee: Hersham Valves Ltd., Walton on Thames, England

[21] Appl. No.: 665,127

[22] Filed: Oct. 26, 1984

[30] Foreign Application Priority Data

Oct. 28, 1983 [GB] United Kingdom ..... 8328902

[51] Int. Cl.[4] ..... F02D 9/06

[52] U.S. Cl. ..... 123/323; 123/345; 123/346

[58] Field of Search ..... 123/323, 345, 346, 347, 123/348, 198 F, 198 DB; 188/273

[56] References Cited

U.S. PATENT DOCUMENTS

| | | | |
|---|---|---|---|
| 3,963,379 | 6/1976 | Ueno | 123/198 F |
| 4,204,512 | 5/1980 | Brock, Jr. | 123/198 F |
| 4,354,464 | 10/1982 | Fujita | 123/323 |
| 4,393,831 | 7/1983 | Bergmann et al. | 123/323 |

FOREIGN PATENT DOCUMENTS

| | | | |
|---|---|---|---|
| 1179765 | 10/1964 | Fed. Rep. of Germany | 123/323 |

*Primary Examiner*—William A. Cuchlinski, Jr.
*Attorney, Agent, or Firm*—Ladas & Parry

[57] ABSTRACT

An exhaust braking system used with an internal combustion engine has an inlet valve an exhaust valve, an exhaust brake connected in an exhaust system connected with the exhaust valve, and an actuator connected in a fluid circuit with the exhaust brake. The exhaust brake is closed to retard the rotational speed of the engine and an induction valve connected in an induction passage to the inlet valve and in the fluid circuit with the exhaust brake is also operated to facilitate engine speed retardation. Timing apparatus is connected with the induction valve and exhaust brake to ensure the exhaust brake is closed no later than the closing of the induction valve, while a non-return valve is connected in the induction passage to facilitating an increase in pressure within a piston cylinder of the engine and hence increase the engine retardation. A pressure sensitive device connected in the induction passage or exhaust system controls the maximum pressure of the braking system. Preferably, the pressure sensitive means is a pressure release valve. The method of operating the exhaust braking system is also disclosed.

12 Claims, 2 Drawing Figures

1/1

1/1

EXHAUST BRAKING SYSTEM FOR AN INTERNAL COMBUSTION ENGINE

Figure 1:
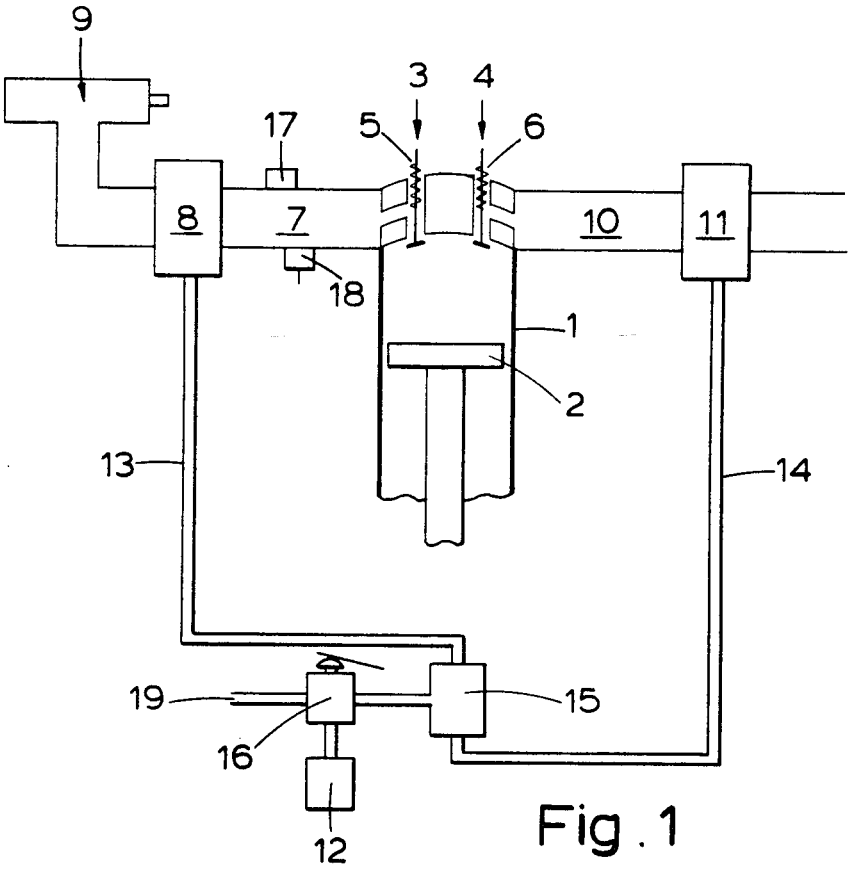

This invention relates to an exhaust braking system for an internal combustion engine and in particular, although not exclusively, to such a braking system for a diesel engine.

It is well known that an exhaust braking system for an internal combusiton engine effects secondary braking working in tandem with the normal friction brakes of a large commercial vehicle. A known exhaust brake comprises a housing with a through passage which is arranged to be closed by a blade when braking is required. The exhaust brake generates a back pressure within the exhaust passage which lifts the exhaust valve from its seating and imparts a back pressure within the cylinder on the piston crown to cause retardation or braking of the rotational speed of the engine and subsequently the vehicle. The amount of back pressure is predominantly dependent upon the force exerted by the engine valve spring, since the back pressure must be sufficient to lift the valve from its seat. It will be appreciated that on the engine induction stroke the piston cylinder is vented to the atmophere through the induction manifold by opening the induction valve so that the exhaust gas pressure within the cylinder is released.

Engine manufacturer's have become concerned that when exhaust brakes are used with internal combustion engines the back pressure created by the exhaust brake when lifting the exhaust valves from the valve seats will create a situation in which a piston upon its return to top dead centre will strike the head of the exhaust valve. To avoid this happening, it is common practice for a hole of a predetermined size to be provided through the blade of the exhaust brake so as to limit the back pressure in the exhaust system. It is desireable to increase the efficiency of the exhaust brake so as to produce greater retardational braking of the engine and one way of achieving such an improvement is to increase the back pressure created by the exhaust brake. However, an increase in the back pressure will only serve to hold the exhaust valve open increasing the likelihood of the piston striking the exhaust valve.

Several ways have been tried to overcome this problem, one of which is to increase the strength of the valve springs, but this is often undesirable since the valve operating mechanisms are then subjected to undue wear.

Therefore, there is a need to provide a braking system for an internal combustion engine in which the above disadvantages are overcome.

According to one aspect of the present invention there is provided an exhaust braking system for an internal combustion engine having an inlet valve and an exhaust valve, the system comprising an induction valve arranged to be connected in an induction passage to the inlet valve, an exhaust brake arranged to be connected in an exhaust system connected with an exhaust valve, actuator means connected in a fluid circuit with the induction valve and exhaust brake for operating the induction valve and exhaust brake to close the induction passage and exhaust system when the rotational speed of the engine is to be retarded, timing means connected with the induction valve and exhaust brake for ensuring the exhaust brake is closed no later than the closing of the induction valve, a non-return valve arranged to be connected in the induction passage between the induction valve and the inlet valve for facilitating an increase in pressure within a piston cylinder of the engine to increase the engine retardation, and pressure relief means arranged to be connected in the induction passage or exhaust system for controlling maximum pressure of the braking system.

Preferably, the pressure sensitive means is a valve, the operating pressure of which is adjustable, but alternatively, the pressure release valve may be of the fixed pressure type to avoid tampering by unauthorised personnel. Conveniently, the pressure release valve is located in the induction passage.

The timing means preferably comprises a pair of tubes of differing internal diameters, the tube of larger internal diameter having one end thereof connectible to the exhaust brake, and the tube of smaller internal diameter having one end thereof connectible to the induction valve, the opposing ends of the tubes being connected to the actuator means.

The actuator means is preferably a manually operative foot valve which is conveniently connected with the brake pedal of a commercial road vehicle, for example. Alternatively, the valve can be operated independently or may be coupled to the accelerator pedal.

According to another aspect of the present invention there is provided a method of operating an exhaust brake system for an internal combustion engine having a inlet valve and exhaust valve, the method comprising actuating an induction valve arranged to be connected in an induction passage to the inlet valve, actuating an exhaust brake arranged to be connected in an exhaust system connected with the exhaust valve, operating acutator means connected in a fluid circuit with the induction valve and exhaust brake to initiate actuation of the induction valve and exhaust brake through the intermediary of timing means connected with the induction valve and exhaust brake for ensuring the exhaust brake is closed no later than the closing of the induction valve to close the induction passage and exhaust system when the rotational speed of the engine is to be retarded, introducing air into the induction passage through a non-return valve connected in the passage between the induction valve and the inlet valve to facilitate an increase in pressure within the piston cylinder of the engine to increase engine retardation, and controlling the maximum pressure of the braking system by venting the system through pressure relief means arranged to be connected in the induction passage or exhaust system.

Figure 2:
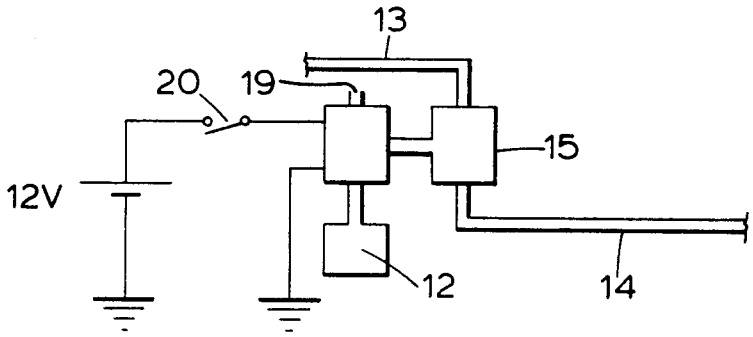

Embodiments of the present invention will now be described by way of example with reference to the accompanying drawings; in which, FIG. 1 is a diagrammatic representation of one exhaust braking system of the invention, and FIG. 2 is a modified form of the system of FIG. 1.

In the drawing, there is illustrated a piston cylinder 1 in which a piston 2 is arranged to reciprocate in a known manner. An inlet valve 3 and exhaust valve 4 operable by the usual engine valve operating mechanism (not shown) against valve springs 5 and 6, control the induction of air and expulsion of exhaust gas to and from the piston cylinder respectively. An induction passage 7 is provided with a pneumatically controlled induction valve 8 which is connected in the induction passage and is operable to close the induction passage 7, thereby preventing the flow of air to the engine from air filter 9.

An exhaust system 10 is provided with a pneumatic exhaust brake 11 which operates to prevent the flow of exhaust gases from the engine and produce a back pressure in the exhaust system 10.

The induction valve 8 and the exhaust brake 11 are connected to a source of compressed air 12 via tubing 13, 14 respectively, a junction box 15 and an acutator device 16 which is manually operated by depression of the brake pedal of a vehicle to which the system is attached. The tube 14 is arranged to have a larger internal diameter than the tube 13 for the reason to be described later herein.

A non-return valve 17 is connected with the induction passage 7 to allow the passsage of air into the induction passage as will hereinafter be described. Conveniently, a pressure release valve 18 is connected in the induction passage for controlling the maximum pressure which is built up within the induction passage, the piston cylinder 1, and the exhaust system.

In the exhaust braking system illustrated in the drawing, the valves 3 and 4 are initially assumed to be closed whilst the valve 8 and exhaust brake 11 are vented to the atmosphere through an exhaust port 19 associated with the actuator device 16. Therefore, the induction passage 7 and exhaust system 10 are open and during normal running conditions the engine operates to drive the vehicle in the usual manner. When the brakes of the vehicle are applied, the brake pedal operates the button 16 closing the exhaust port 19 to allow compressed air to be supplied from the compressed air source 12 through the junction box 15 and tubes 13 and 14 to the valve 8 and the exhaust brake 11. Since the internal diameter of the tubing 13, 14 is such that tubing 13 has a smaller internal diameter than the tubing 14, the exhaust brake 11 is operated earlier than the valve 8 by approximately one second, thereby creating a back pressure in the exhaust passage 10 of, for example, 40 psi (275.8 kPa). This pressure is arranged to be sufficient to overcome the force of the valve spring 6 of the exhaust valve 4 and force the valve into an open position whereupon the pressure in the exhaust passage is transferred to the piston cylinder 1 and applied to the crown of the piston 2.

Assuming the exhaust brake 11 is operated immediately after an air fuel mixture is ignited in the cylinder 1, the piston 2 begins to travel downwardly in the drawing. The pressure builds up in the exhaust passage 10, utilising exhaust gases from other cylinders of the engine, until it is sufficiently high to open the exhaust valve 4. As the piston 2 begins to move upwardly on its next stroke, the exhaust valve 4 is forceably opened by the valve operating mechanism in the usual manner to facilitate expulsion of exhaust gas. During this period pressure increases in the exhaust system 10 and piston cylinder 1 as the the piston 2 compresses the gases within the piston cylinder 1 and exhaust system 10. Therefore, as the piston 2 moves upwardly on the exhaust stroke pressure equalisation occurs between the piston cylinder 1 and exhaust system 10. The force then acting on the inner surface of the head of the exhaust valve 4 is greater than the force acting on the opposite surface of the head of the exhaust valve, so that when the valve operating mechanism releases the exhaust valve, the valve will close under the influence of the valve spring 6 and the force differential between the two sides of the valve head.

On the next stroke the piston 2 proceeds in the downwardly direction in the drawing, that is on the induction stroke. The inlet valve 3 is opened and the pressure within the cylinder 1 and exhaust passage 10 is transferred to the induction passage 7 which is blocked by the closed induction valve 8. As the piston 2 moves downwardly on this induction stroke, a slight reduction in pressure is experienced within the cylinder 1 and consequently air is drawn into the induction inlet through the non-return valve 17. The pressure within the induction passage 7 and exhaust system 10 serves to hold open the inlet valve 3 and exhaust valve 4 as the piston begins its next upward stroke which is the firing stroke, and begins to compress the gases trapped within the induction passage, piston cylinder and exhaust system as well as the additional air introduced through the non-return valve and the inlet and outlet valves 3, 4 close in the manner described above in respect of the exhaust valve 4. Accordingly, an increase in the pressure of the gases occurs within the piston cylinder.

As the piston 2 continues to reciprocate within the piston cylinder 1, pressure begins to build up between the induction passage 7, the piston cylinder 1 and the exhaust system 10 until a suitable level throughout is reached, whereupon the occurrence of any further increase in a pressure relief valve 18 connected to the induction passage is operated to vent the system to the atmosphere.

The result of the operation of this exhaust braking system is to increase the retardation effect of the engine by increasing the pressure which can be used within the engine and yet maintaining valve springs of orginally designed perameters.

One known low compression diesel engine operates with a normal internal compression of approximately 22 psi (151.7 KPa) and in utilising a known exhaust brake system, operates with a back pressure of 22 psi which is built up in the exhaust system and on the induction stroke of the engine, the gases at this pressure are transferred or vented to atmosphere through the air filter 9. Accordingly, the maximum pressure which can be used for retarding that engine is 22 psi which is governed by the strength of the valve springs used on the engine.

However, with the exhaust braking system of applicants invention, the pressures which can be utilised within such an engine for effecting retardation can be taken from say 22 psi up to 60 psi (403.7 KPa) or even higher without altering the engine valve springs. The reason for this is that the general equalisation of pressure between the induction passage, the piston cylinder 1 and the exhaust system 10 ensures that the pressure which need be applied to normally open the inlet and exhaust valves, irrespective of the pressure in the system is substantially identical to or within the necessary tolerances of the pressures applied when the engine is in its normal running condition with the valves 8 and 11 open.

In the embodiment described above the timing between the operation of the exhaust brake 11 and induction valve 8 is achieved using tubing of different internal diameters connected to a common source of compressed air. In another embodiment the tubing diameters are identical and a flow control valve is connected to one of the tubes to control the time delay. The flow control valve can be standard pneumatic timing device such as that manufactured by Eynots.

In another embodiment, as shown in FIG. 2 the actuator comprises an electrical switch 20 which is connected in series with a solenoid operated valve 21 in turn connected with the exhaust brake 11 and induction valve 8 via pipes 13, 14. With the electrical switch 20 in its open position the exhaust brake 11 and induction valve 8 are open. When the speed of the engine is to be retarded the switch 20 is closed, the solenoid 21 is energised and the exhaust brake 11 and induction valve 8 are operated to close the exhaust and induction passages, respectively for operation of the system as described with reference to FIG. 1.

In an alternative embodiment the induction valve and exhaust brake are each operated electromagnetically and an electric timing circuit is used to control the time delay between the switching on of the exhaust brake 11 and the induction valve 8. Preferably, the time delay is one second although the valves 8,11 can operate at longer or shorter time periods or simultaneously as desired.

The pressure sensitive device 18 may take the form of any well known electro-pneumatic device arranged to monitor the pressure in the induction and exhaust passages 7, 10 to transmit eletrical signals to the induction valve 8 or exhaust brake 11 to open one sufficently to relieve the pressure in the system to a desired level. In such an arrangement the pressure relief valve would not be required. The opening of the induction valve or exhaust brake is continuously variable to maintain the required pressure.

The induction valve is conveniently an exhaust brake but can be any other suitable gate valve or butterfly valve which in the open condition does not interfere with the passage of air to the piston cylinder 1.

In the FIG. 2 embodiment the switch 20 may be connected in circuit with a micro-switch so that when switch 20 is closed the micro-switch is activated to operate the solenoid which in turn actuates the exhaust brake 11 and induction valve 8 as previously described.

I claim:

1. An exhaust braking system for an internal engine having an inlet valve and an exhaust valve, the system comprising an induction valve arranged to be connected in an induction passage to the inlet valve, an exhaust brake arranged to be connected in an exhaust system connected with an exhaust valve, actuator means connected in a fluid circuit with the induction valve and exhaust brake for operating the induction valve and exhaust brake to close the induction passage and exhaust system when the rotational speed of the engine is to be retarded, timing means connected with the induction valve and exhaust brake for ensuring the exhaust brake is closed no later than the closing of the induction valve, a non-return valve arranged to be connected in the induction passage between the induction valve and inlet valve for facilitating an increase in pressure within a piston cylinder of the engine to increase the engine retardation, and pressure sensitive means arranged to be connected in the induction passage for controlling maximum pressure of the braking system.

2. An exhaust braking system for an internal combustion engine having an inlet valve and an exhaust valve, the system comprising an induction valve arranged to be connected in an induction passage to the inlet valve, an exhaust brake arranged to be connected in an exhaust system connected with an exhaust valve, actuator means connected in a fluid circuit with the induction valve and exhaust brake for operating the induction valve and exhaust brake to close the induction passage and exhaust system when the rotational speed of the engine is to be retarded, timining means connected with the induction valve and exhaust brake for ensuring the exhaust brake is closed no later than the closing of the induction valve, a non-return valve arranged to be connected in the induction passage between the induction valve and inlet valve for facilitating an increase in pressure within a piston cylinder of the engine to increase the engine retardation, and pressure sensitive means arranged to be connected in the exhaust system for controlling maximum pressure of the braking system.

3. A system according to claim 1, wherein the pressure sensitive means is a pressure release valve.

4. A system according to claim 1, wherein the pressure sensitive means is an electrically operable pressure release valve.

5. A system according to claim 4, wherein the pressure sensitive means is operative to release pressure within the induction or exhaust system by controlling the opening of the induction valve or exhaust brake.

6. A system according to claim 5 wherein the operable pressure of the pressure sensitive means is adjustable.

7. A system according to claim 5 wherein the pressure release valve is a fixed pressure type.

8. A system according to claim 1, wherein the timing means comprises a pair of tubes of differing internal diameter, the tube of larger internal diameter has one end thereof connectable to the exhaust brake, and the tube with smaller internal diameter having one end thereof connectable to the induction valve, the opposing ends of the tubes being connected to the actuator means.

9. A system according to claim 1, wherein the actuator means comprises a mannually operable foot valve which is conveniently connected with the brake pedal of a commercial road vehicle.

10. A system according to claim 1, wherein the actuator means comprises an electrically operable valve controllable with an electric switch.

11. A method of operating an exhaust brake system for an internal combustion engine having an inlet valve and exhaust valve, the method comprising actuating an induction valve arranged to be connected in an induction passage to the inlet valve, actuating an exhaust brake arranged to be connected in an exhaust system connected with the exhaust valve, operating actuating means connected in a fluid circuit with the induction valve and exhaust brake to initiate actuation of the induction valve and exhaust brake through the intermediary of timing means connected with the induction valve and exhaust brake for ensuring the exhaust brake is closed no later than the closing of the induction valve to close the induction passage and exhaust system when the rotational speed of the engine is to be retarded, introducing the air into the induction passage through a non-return valve connected in the passage between the induction valve and inlet valve to facilitate increase in pressure within the piston cylinder of the engine to increase engine retardation, and controlling the maximum pressure of the braking system by venting the system through pressure sensitive means arranged to be connected in the induction passage.

12. A method of operating an exhaust brake system for an internal combustion engine having an inlet valve and exhaust valve, the method comprising actuating an induction valve arranged to be connected in an induction passage to the inlet valve, actuating an exhaust brake arranged to be connected in an exhaust system connected with the exhaust valve, operating actuating means connected in a fluid circuit with the induction valve and exhaust brake to initiate actuation of the induction valve and exhaust brake through the intermediary of timing means connected with the induction valve and exhaust brake for ensuring the exhaust brake is closed no later than the closing of the induction valve to close the induction passage and exhaust system when the rotational speed of the engine is to be retarded, introducing the air into the induction passage through a non-return valve connected in the passage between the induction valve and inlet valve to facilitate increase in pressure within the piston cylinder of the engine to increase engine retardation, and controlling the maximum pressure of the braking system by venting the system through pressure sensitive means arranged to be connected in the exhaust system.

* * * * *